United States Patent [19]

Jasper

[11] 4,221,363

[45] Sep. 9, 1980

[54] ADJUSTABLE JACK

[75] Inventor: Allen L. Jasper, Morgantown, W. Va.

[73] Assignee: National Mine Service Company, Pittsburgh, Pa.

[21] Appl. No.: 949,233

[22] Filed: Oct. 6, 1978

[51] Int. Cl.[2] ..... B66F 3/08

[52] U.S. Cl. ..... 254/98; 85/32 R; 248/354 S

[58] Field of Search ..... 248/354 R, 354 S, 355; 85/32 R, 46; 254/98, 133 A; 269/173

[56] References Cited

U.S. PATENT DOCUMENTS

| | | | |
|---|---|---|---|
| 743,290 | 11/1903 | Ketterer | 254/98 |
| 1,475,907 | 11/1923 | Volman | 269/173 |
| 1,612,124 | 12/1926 | Huelsick | 254/98 |
| 1,784,991 | 12/1930 | Holmes | 254/98 |
| 1,785,069 | 12/1930 | Boudette | 254/98 |
| 2,218,319 | 10/1940 | Pfauser | 254/98 |
| 2,316,432 | 4/1943 | Hott | 254/98 |
| 2,654,567 | 10/1953 | James | 254/98 |
| 2,783,809 | 3/1957 | Haines | 254/98 |
| 3,022,043 | 2/1962 | Weiss | 254/98 |
| 3,210,047 | 10/1965 | Jackson | 254/98 |
| 3,603,552 | 9/1971 | Wheeloch | 254/98 |
| 3,667,730 | 6/1972 | Kollmar | 254/98 |

FOREIGN PATENT DOCUMENTS

| | | | |
|---|---|---|---|
| 821802 | 10/1959 | United Kingdom | 248/354 S |

*Primary Examiner*—Robert C. Watson

*Attorney, Agent, or Firm*—Stanley J. Price, Jr.; John M. Adams

[57] ABSTRACT

An adjustable jack includes a tubular support member adapted to be positioned vertically on the floor of an entry in an underground mine. An adjusting screw is telescopically positioned within the support member to advance a load bearing plate into engagement with the roof of the mine entry. A nut assembly positioned on the adjusting screw includes a pair of body portions which surround the adjusting screw and are connected to move radially into and out of threaded engagement with the adjusting screw. A retainer secured to the upper end of the tubular support member is arranged to rotatably receive the nut assembly. When the nut assembly is positioned in the retainer, the nut body portions are positioned in threaded engagement with the adjusting screw to permit advancement of the adjusting screw by rotation of the nut assembly. To rapidly advance the adjusting screw to the working height of the jack, the nut assembly is moved upwardly out of the retainer permitting the nut body portions to separate out of threaded engagement with the adjusting screw. The adjusting screw is then free to advance by nonrotational linear movement from the support member through the nut assembly to position the load bearing plate in contact with the mine roof. The nut assembly is returned to the retainer for final adjustment of the jack to exert a preselected compressive force upon the mine roof by rotation of the adjusting screw.

12 Claims, 6 Drawing Figures

ADJUSTABLE JACK

BACKGROUND OF THE INVENTION

1. Field of the Invention

This invention relates to an adjustable jack and more particularly to an adjustable mine roof support jack having an adjusting screw operable in one mode for rapid nonrotational linear advancement to the desired working height and in a second mode for slow rotational advancement to a final load bearing position.

2. Description of the Prior Art

In underground mining, as the working face is advanced by the mining machine the entryway thus formed has an unsupported roof which must be supported by a roof control system to prevent roof subsidence. In the past it was the conventional practice to provide roof control by building cribs, setting timbers and the like. However, such roof control measures involve a large amount of labor and substantial expense in supplying materials which are not recoverable for reuse.

More recently mechanical roof control systems have been developed to provide rapidly adjustable means for supporting a mine roof, such as hydraulic jacks, rams, and props. However, these devices are complex requiring a large inventory of replacement parts and are subject to malfunction which delay the erection of the roof support system and consequently the mining operation.

A known means for providing a dependable roof support system that is quick setting and sufficiently rugged in construction for use in a mine is the screw-type roof jack which is adjustable in height to provide roof control in any underground mine. Examples of such adjustable jacks are disclosed in U.S. Pat. Nos. 1,784,991 and 1,785,069 and include a main tubular body portion having a telescoping screw rod that is releasably engagable with an adjustment means carried by the tubular body portion. To effect rapid extension of the screw rod into load bearing relation with the mine roof, the adjustment means is released from threaded engagement with the screw rod to permit the screw rod to extend without requiring lengthy revolving of a crank handle. In this manner the jack is quickly extensible to the desired load bearing height as determined by the height of the mine roof. Final load bearing adjustment is accomplished by returning the adjusting means to threaded engagement with the screw rod for rotational advancement thereof by turning the adjusting means. A similar device is disclosed in U.S. Pat. No. 3,210,047 for shoring concrete slabs to various lengths in which a shoring jack includes jaws movable into and out of clamping engagement with a load engaging tube to facilitate adjustments in the shoring length.

In U.S. Pat. No. 3,603,552 an adjustable strut is provided with an inner screw thread releasably engagable by a rotatable, split nut which when disengaged from the screw thread effects rapid adjustment of the strut. The ends of the strut are provided with load-engaging thrust plates, and the overall length of the strut between the thrust plates is adjusted by rotating the nut when engaged with the screw thread. U.S. Pat. Nos. 3,022,043 and 3,667,730 disclose quick acting trailer jacks for supporting and leveling a travel trailer. The jacks are permanently mounted to the draw bar of the trailer and are operable for rapid extension and retraction without requiring lengthy revolving of a crank handle.

Mechanical jacks featuring quickly adjustable extensions are also disclosed in U.S. Pat. Nos. 1,612,124; 2,218,319; and 2,316,432. Each of these devices includes clamping means for releasably engaging an elongated threaded rod to permit telescoping action of the jack by both rapid nonrotational advancement and slower rotational advancement of the jack.

A hingedly connected split nut is also illustrated in U.S. Pat. No. 2,654,567. The split nut includes halves which are internally threaded to engage the external threads of a tubular screw. A pipe to be pulled extends through the hollow interior of the tubular screw. Rotation of a ratchet pulls the pipe in a desired direction.

While it has been suggested by the prior art devices to provide adjustable jacks operable for rapid nonrotational linear extension and for rotational extension to a final setting, there is need for an adjustable jack that is operable to be quickly converted between nonrotational and rotational extension to facilitate quick setting of the jack as in use for mine roof control and to maintain a compressive load upon the mine roof without slippage of the telescoping member.

SUMMARY OF THE INVENTION

In accordance with the present invention there is provided an adjustable jack that includes a tubular support member in which the tubular support member has a first end portion and a second end portion. An adjusting screw is telescopically positioned in the tubular support member. The adjusting screw has an externally threaded portion. A nut assembly is provided and has a pair of radially movable body portions. The nut assembly body portions each have an internally threaded portion engagable with the adjusting screw externally threaded portion. Means is provided for moving the internally threaded portions of the nut assembly body portions into and out of engagement with the adjusting screw externally threaded portion. A retainer device is secured to the tubular support member first end portion for rotatably receiving the nut assembly. The nut assembly is movable into and out of engagement with the retainer device. The nut assembly internally threaded portions are engagable with the adjusting screw externally threaded portion when the nut assembly is positioned in the retainer device so that rotation of the nut assembly in a first direction rotatably extends the adjusting screw from the first end portion of the tubular support member and in a second direction rotatably retracts the adjusting screw into the first end portion of the tubular support member. The nut assembly internally threaded portions are disengagable with the adjusting screw externally threaded portion when the nut assembly is removed from the retainer device to permit nonrotational linear extension and retraction of the adjusting screw from and into the first end portion of the tubular support member.

The nut assembly is split along a diametrical axially extending plane to form the two body portions. Each body portion has an internal bore which is threaded along the entire axial length thereof. Each body portion is provided at the upper end portion thereof with a handle that extends radially outwardly from the respective body portion, and the handles are operable when the nut assembly is positioned in the retainer device to transmit rotation to the adjusting screw for extending the adjusting screw by rotational movement. The lower portion of each nut assembly body portion is provided with axially spaced ring members having a diameter less than the diameter of the retainer device axial bore to permit movement of the nut assembly into and out of the retainer device and correspondingly into and out of threaded engagement with the adjusting screw.

The respective body portions of the nut assembly are connected by drift pins extending through aligned passageways of the body portions to facilitate radial movement of the body portions toward and away from each other. The body portions when withdrawn from the retainer device are urged outwardly by resilient devices, such as compression springs, to radially separate the body portions and thereby threadedly disengage the adjusting screw.

Preferably, in operation as a mine roof-support system, the second end portion of the tubular support member is positioned on a supporting surface such as blocking or a mine floor. The upper end portion of the adjusting screw is connected to a load bearing support plate which is extended from the tubular body portion by rapid nonrotational linear advancement into load bearing engagement with the mine roof or blocking abutting the mine roof. Removing the nut assembly from the retainer device is required, however, to threadedly disengage the nut assembly from the adjusting screw to permit rapid telescoping of the adjusting screw to the desired mine roof supporting height without requiring lengthy rotation of the nut assembly handles.

The nut assembly when withdrawn from the bore of the retainer device is free to separate in a radial direction from threaded engagement with the adjusting screw by extension of the compression springs acting against the body portions of the nut assembly. The clamping forces urging the internal threads of the nut assembly into meshing relation with the external threads of the adjusting screw are relieved, permitting the adjusting screw to pass freely through the separated body portions of the nut assembly. Thus, the adjusting screw may be rapidly extended or collapsed to quickly adjust the working height of the jack.

Once the jack has been advanced to a preselected working height, final adjustment of the working height is accomplished by positioning the nut assembly in the retainer device. The retainer device applies inward radial forces upon the nut assembly body portions, which forces overcome the separating forces exerted by the compression springs on the body portions to move the threads of the body portions into meshing relation with the threads of the adjusting screw. This locks the nut assembly to the adjusting screw to permit extensibility of the adjusting screw by rotation of the nut assembly. The jack is finally extended to a desired working height or to apply a preselected compression force through the load bearing plate or blocking upon the mine roof. Thus, in practice a plurality of adjustable jacks of the present invention are operable to be quickly set in position in a mine to provide a safe, dependable roof-support system.

Accordingly, the principal object of the present invention is to provide a fast setting jack that is adjustable to a preselected load bearing height without requiring lengthy rotation of an adjusting screw to position a load bearing plate into a final load bearing position.

Another object of the present invention is to provide an adjustable jack operable for use in an underground mine to support a mine roof by rapid extension of a telescoping member without rotation to a preselected vertical height into contact with the mine roof and by rotation of the telescoping member to a final load bearing position to support the mine roof.

These and other objects of this invention will be more completely described and disclosed in the following specification, the accompanying drawings and the appended claims.

DESCRIPTION OF THE PREFERRED EMBODIMENT

Figure 1:
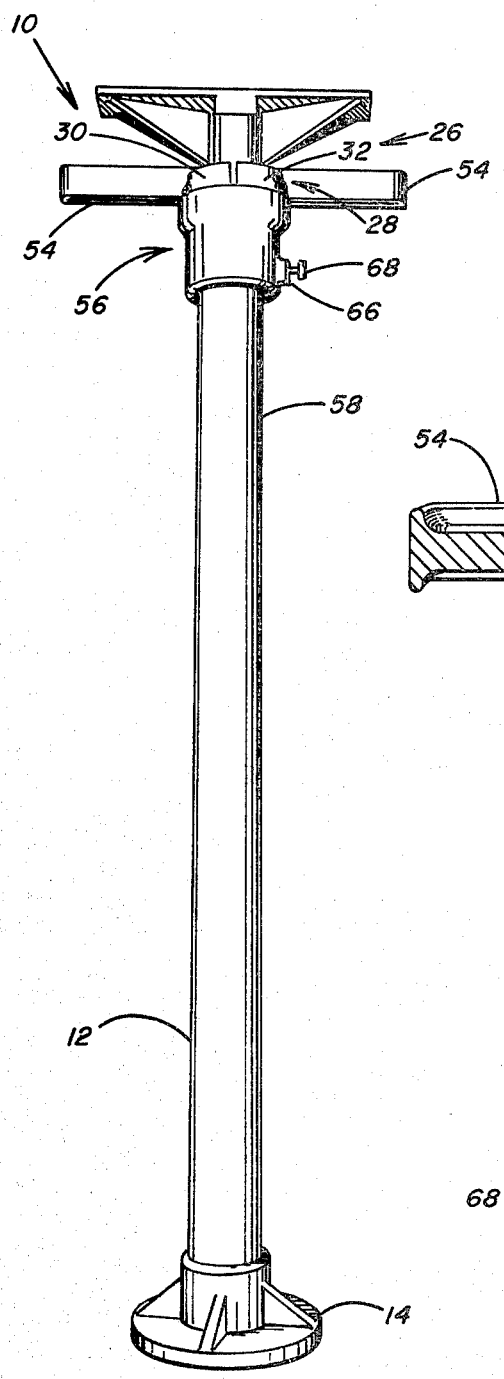
FIG. 1 is a view in side elevation of the adjustable jack of the present invention, illustrated in a fully collapsed position.
Figure 2:
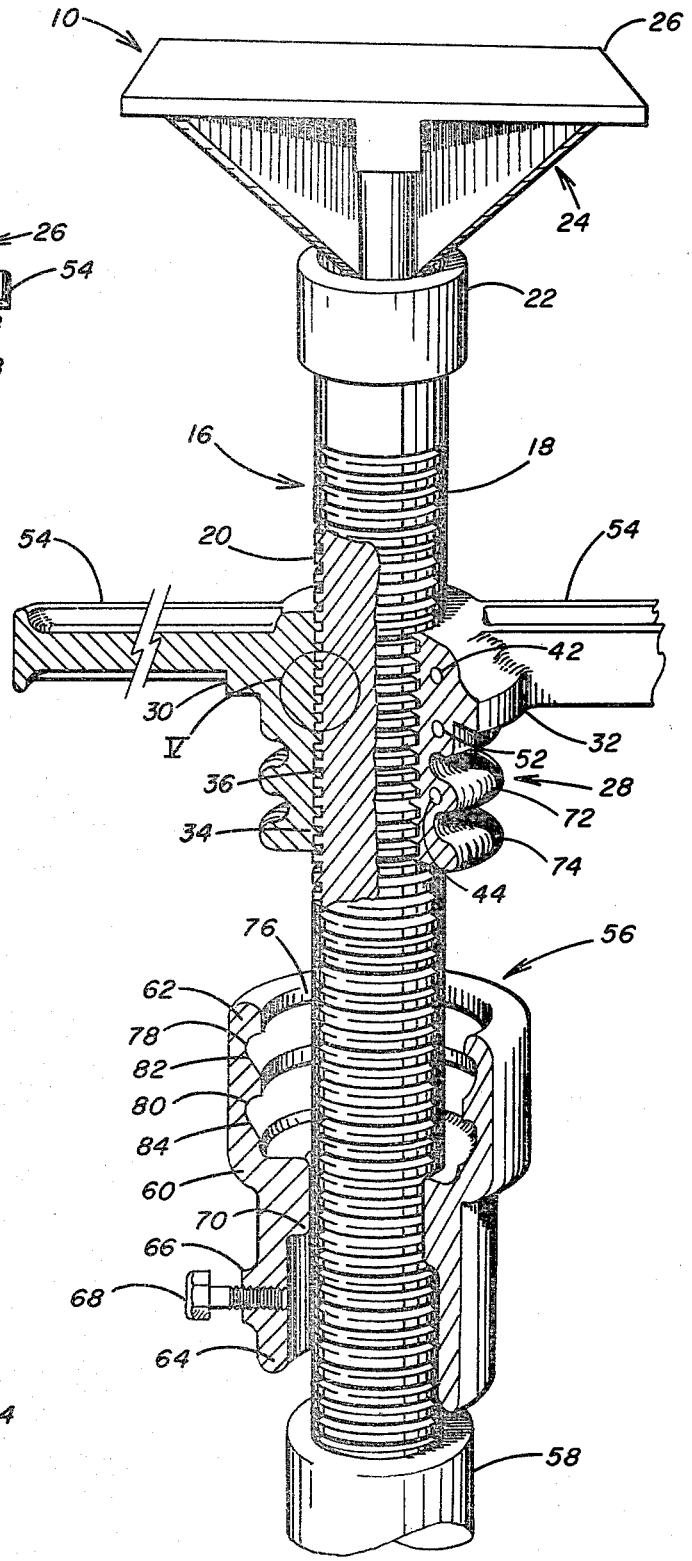
FIG. 2 is a fragmentary exploded view, partially in section, of the adjustable jack, illustrating the threaded engagement of the nut assembly with the adjusting screw and the retainer device for receiving the nut assembly for advancing the adjusting screw by rotation of the nut assembly.

Referring to the drawings and particularly to FIGS. 1 and 2 there is illustrated an adjustable jack generally designated by the numeral 10 that includes an outer tubular support member 12 having a base portion 14 that is adapted for positioning on a firm surface, such as a floor of an entry in an underground mine. An adjusting screw generally designated by the numeral 16, as illustrated in FIG. 2, telescopically extends within the tubular support member 12. The adjusting screw 16 has an outer peripheral surface 18 upon which is formed substantially the entire axial length thereof threads 20. The adjusting screw 16 includes a lower end portion (not shown) which is retained in the tubular support member 12 and an upper end portion 22 to which is suitably secured a load bearing assembly generally designated by the numeral 24 that includes a thrust plate or the like having a planar load bearing surface 26 adapted to be advanced into engagement with the roof of a mine entry to support the roof against subsidence. Thus, a plurality of adjustable jacks of the present invention are operable in underground mining operations to provide a quick setting, dependable roof-support system.

On the threaded portion of the adjusting screw 16 is mounted a nut assembly generally designated by the numeral 28. The nut assembly 28 is split along a diametrical axially extending plane to provide two halves or body portions 30 and 32 each having an axially extending semicircular interior surface 34 which is provided with threads 36 operable to move into and out of meshing relation with the threads 20 of the adjusting screw 16.

Figure 3:
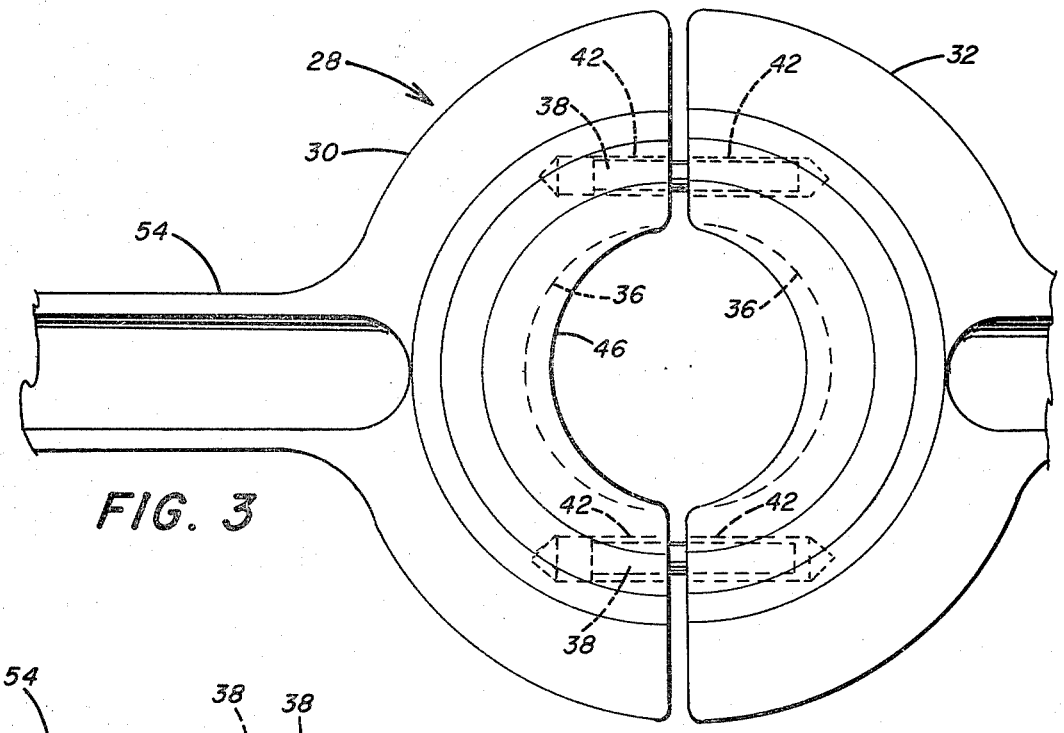
FIG. 3 is a fragmentary top plan view of the nut assembly, illustrating the connection of the nut assembly halves for radial movement of the internal threads of the nut assembly into and out of engagement with the external threads of the adjusting screw.
Figure 4:
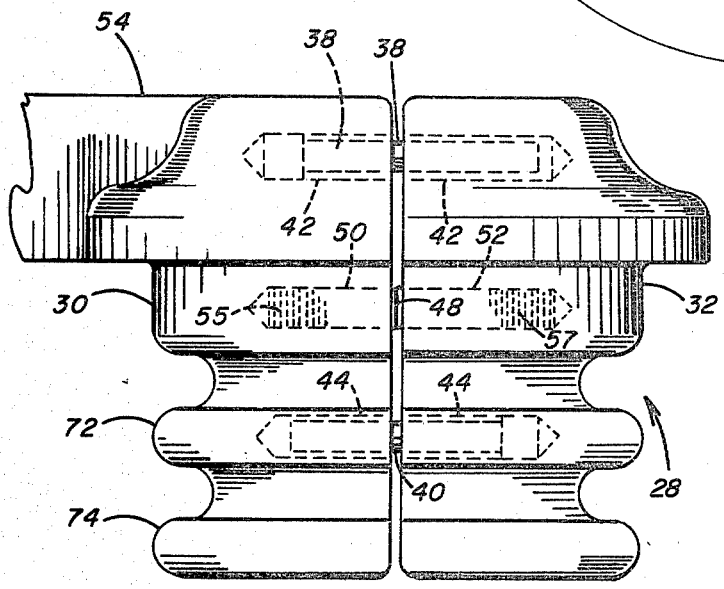
FIG. 4 is a fragmentary view in side elevation of the nut assembly shown in FIG. 3, illustrating the connection of the nut assembly body portions for radial movement into and out of threaded engagement with the adjusting screw.

The nut assembly body portion halves 30 and 32 are connected together by pairs of drift pins 38 and 40, as illustrated in FIGS. 3 and 4. Each of the nut assembly body portions 30 and 32 includes corresponding pairs of horizontally positioned passageways 42 and 44 in which the pairs of passageways 42 in body portion 30 are aligned with the pairs of passageways 42 in the body portion 32. Similarly, below the aligned pairs of passageways 42 are positioned in the body portions 30 and 32 the aligned horizontal passageways 44. As further illustrated in FIG. 3, the oppositely aligned and corresponding pairs of passageways 42 and 44 are diametrically opposed opposite a threaded bore 46 formed by the nut assembly body portions 30 and 32.

Preferably, the pairs of drift pins 38 are secured to the nut assembly body portion 30 in the passageways 42 thereof with the opposite end portions of the drift pins 38 movably retained within the passageways 42 of the nut assembly body portion 32. Accordingly, as illustrated in FIG. 4 the drift pins 40 are secured to the body portion 32 within the passageways 44 with the opposite end portions of the drift pins 40 movably retained in the passageways 44 in the body portion 30. With this arrangement, the respective body portion halves 30 and 32 are operable to move toward and away from each other in which the movement is confined to horizontal radial movement toward and away from the adjusting screw 16. This arrangement also ensures, as will be explained later in greater detail, positive meshing engagement of the nut assembly with the adjusting screw.

To facilitate extension and retraction of the adjusting screw 16 by both rotation of the adjusting screw and rapid nonrotational linear advancement of the adjusting screw, the nut assembly 28 is provided with resilient devices, such as a pair of compression springs 48 (only one of which is illustrated in FIG. 4) that are positioned in aligned passageways 50 and 52 of the nut assembly body portions 30 and 32 respectively. The springs 48 have opposite end portions 55 and 57 which are positioned in abutting relation with the body portions 30 and 32 at the end of the passageways 50 and 52 respectively.

When the internal threads 36 of the body portions 30 and 32 mesh with the external threads 20 of the adjusting screw 16, the combined length of the passageways 50 and 52 is less than the free length of the spring members 48 so that the springs 48 are compressed by the nut assembly. However, when the nut assembly 28 is disengaged from threaded engagement with the adjusting screw 16, the compressed springs 48 are free to expand thus permitting the body portion halves to separate and disengage the adjusting screw. In view of the fact that the length of the drift pins 38 and 40 exceeds the free length of the springs 48, the separated body portion halves 30 and 32 remain connected by the drift pins 38 and 40. Connection of the body portion halves 30 and 32 by the drift pins 38 and 40 confines the body portions to radial movement into and out of threaded engagement with the adjusting screw.

The nut assembly 28 also includes a pair of handles 54 which are diametrically positioned and suitably secured as by welding to the body portions 30 and 32. As will be explained later in greater detail rotation of the nut assembly 28 is accomplished by turning handles 54 in a preselected direction. In this manner final adjustment of the adjustable jack in contact with a compressive load is made.

A retainer device generally designated by the numeral 56 is suitably secured to upper end portion 58 of the tubular support member 12. The retainer device 56 is adapted to receive the nut assembly 28 to maintain the nut assembly 28 in threaded engagement with the adjusting screw 16 to facilitate extension or retraction of the adjusting screw 16 relative to the tubular support member 12 by rotation of the handles 54. The retainer device has a tubular body portion 60 that includes an enlarged upper end portion 62 having an outer cylindrical surface and a reduced lower end portion 64 having an outer cylindrical surface provided with a protrusion 66 for receiving a set screw 68 that extends through the body portion 60.

As illustrated in FIG. 1, the lower end portion 64 of the retainer device 56 is positioned in surrounding relation with the upper end portion 58 of the tubular support member 12. As illustrated in the disassembled exploded view in FIG. 2, the body portion 60 of the retainer 56 includes an inturned shoulder 70 that separates the upper end portion 62 from the lower end portion 64. When the retainer device 56 is assembled on the tubular support member 12, as illustrated in FIG. 1, the retainer device lower end portion 64 is extended downwardly in surrounding relation with the tubular support member 12 until the inturned shoulder 70 contacts the upper end portion 58 so that the upper end portion 58 is positioned in the annulus formed between the retainer device lower end portion 64 and the adjusting screw 16. The set screw 68 as illustrated in FIG. 1, is advanced through the retainer device body portion 60 and into an aligned threaded bore (not shown) of the tubular support member 12 to further secure the retainer device 56 on the tubular support member 12.

As illustrated in FIGS. 2 and 4 each of the nut assembly body portions 30 and 32 are provided on the outer periphery thereof with a plurality of radially extending protrusions or ring members 72 and 74. The ring members 72 and 74 of body portion 30 are diametrically opposed relative to the ring members 72 and 74 of the body portion 32. The upper end portion 62 of the retainer device 56 is provided with an axial bore 76 having a diameter greater than the diameters of the ring members 72 and 74 to facilitate unobstructed longitudinal movement of the lower end portion of the nut assembly into and out of the axial bore 76.

Preferably, to position the nut assembly 28 in the axial bore 76 an inward radial force is exerted upon the handles 54 to slightly compress the spring members 48 but at the same time permit the nut assembly 28 to move freely on the adjusting screw 16 without engaging the threads thereof. In order to rotatably support the nut assembly 28 in the axial bore 76 of the retainer device 56, a plurality of annular recesses 78 and 80 are axially spaced along the length of the bore 76. The diameter of the annular recesses 78 and 80 is greater than the diameter of the axial bore 76. Inclined cam faces 82 and 84 extend downwardly from the respective recesses 78 and 80 to the axial bore 76.

When the nut assembly 28 is positioned within the axial bore 76 of the retainer device 56, the ring members 72 and 74 are positioned oppositely of the recess portions 78 and 80. The nut assembly 28 is thus positioned to facilitate upward or downward movement of the adjusting screw 16 by rotation of the adjusting screw 16 through the nut assembly 28. In operation once the adjusting screw 16 has been rapidly advanced to a position where a compressive load is applied to the load bearing surface 26 of the load bearing assembly 24, the nut assembly 28 is lowered into the retainer device 56 to permit extensibility of the adjusting screw 16 to a final setting by rotation thereof. In this mode of operation the internal threads 36 of the nut assembly body portions 30 and 32 mesh with the external threads 20 of the adjusting screw 16. Further, in this position, the ring members 72 and 74 are positioned oppositely of the annular recesses 78 and 80.

Figures 5, 6:
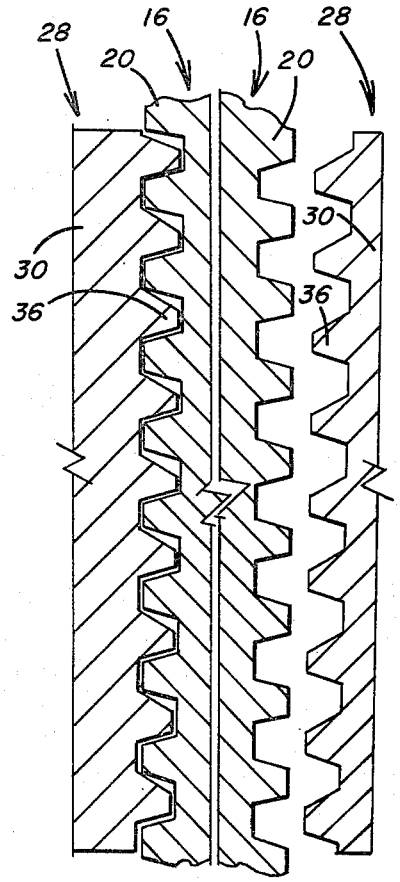
FIG. 5 is a fragmentary, sectional view of the engagement of the internal threads of the nut assembly with the external threads of the adjusting screw when the nut assembly is positioned in the retainer device.
FIG. 6 is a fragmentary sectional view similar to FIG. 5, illustrating the internal threads of the nut assembly disengaged from the external threads of the adjusting screw when the nut assembly is removed from the retainer device.

As the handle 54 is turned in a preselected direction to adjust the height of the load bearing surface 26 by rotation of the adjusting screw 16, the nut assembly threads 36, as illustrated in FIG. 5, overlie the threads 20 of the adjusting screw 16. As a compressive load is applied to the adjusting screw the ring members 72 and 74 are urged down the inclined cam faces 82 and 84 to further move the nut assembly threads 36 into meshing relation with the adjusting screw threads 20. In this manner the nut assembly 28 is moved into load transmitting engagement with the retainer device 56. Thus, as the ring members 72 and 74 move down the inclined faces 82 and 84 as the handles 54 are turned, the threads 36 and 20 are positively engaged to prevent slippage of the adjusting screw 16 relative to the nut assembly 28 during the final setting of the jack 10 and when the jack 10 is finally set and under a compressive load.

Further, as illustrated in FIG. 5, the upper surface of the internal threads 36 of the nut assembly 28 has a greater inclination relative to the longitudinal axis of the nut assembly than the lower surface of the threads of the nut assembly, as well as, the upper and lower surface of the Acme screw threads 20 of the adjusting screw 16. With this arrangement, a short upward extension of the nut assembly 28 out of the retainer device 56 permits disengagement of the nut assembly threads 36 from the adjusting screw threads 20. Consequently, the nut assembly is released from engagement with the adjusting screw, as illustrated in FIG. 6, to permit free movement of the adjusting screw through the nut assembly. It will be further apparent with the present invention that the above described configuration of the internal threads 36 of the nut assembly 28 provides sufficient clearance between the meshing nut assembly and the adjusting screw for the passage of small dirt particles through the nut assembly to prevent locking or freezing of the nut assembly on the adjusting screw. This feature is particularly advantageous when the jack 10 is used in the dusty environment of an underground mine.

Further in accordance with the present invention, to remove the load bearing surface 26 from contact with a compressive load, as for example from contact with a mine roof, the handle 54 is turned in a preselected direction to rotate the nut assembly and rotatably retract the adjusting screw 16. Once the load is removed from the bearing surface 26, the ring member 72 and 74 are no longer in load transmitting engagement with the inclined cam faces 82 and 84. The nut assembly 28 can then be removed from the axial bore 76 of the retainer device 56, permitting the nut assembly body portions 30 and 32 to be separated by the outward radial forces exerted thereon by the springs 48 out of engagement with the adjusting screw 16. In this manner the adjusting screw 16 is operable to be rapidly retracted in the tubular support member 12 by nonrotational linear advancement.

Preferably, in operation the adjustable jack 10 is initially in the collapsed position, as illustrated in FIG. 1, where the adjusting screw 16 is positioned within the tubular support member 12 so that the upper end portion 22 of the screw abuts the end of body portion 32 of nut assembly 28. With the jack 12 in a fully collapsed position, rapid extension of the screw 16 from the tubular support member 12 is effected by exerting an upward force upon the nut assembly 28 to advance the nut assembly and the adjusting screw 16 together so that the nut assembly 28 moves out of the axial bore 76 of the retainer device 56. Only a short extension of the nut assembly 28 out of the retainer device 56 is required to disengage the nut assembly threads 36 from the adjusting screw threads 20.

When the nut assembly 28 is removed from the retainer axial bore 76 the compressive forces exerted upon the springs 48 by the retainer device 56 are released permitting the springs to extend and separate the body portions of the nut assembly 28. This action permits the threads 36 of the nut assembly to clear the threads 20 of the adjusting screw. Further, the separation of the nut assembly 28 from threaded engagement with the adjusting screw 16 is facilitated by the inclination of the threads of the nut assembly as above described. Thus once the nut assembly 28 is removed from load transmitting engagement with the retainer device 56, the threads of the nut assembly are free to move relative to the threads of the adjusting screw.

In use in supporting a mine roof by the adjustable jack 10 of the present invention, the base portion 12 is positioned in contact with the mine floor. Preferably, during the rapid extension of the adjusting screw 16, the tubular support member 12 is positioned at an angle inclined from the vertical with a block member positioned on the bearing surface 26 of the load bearing plate to increase the area of contact of the jack with the mine roof. Once the adjusting screw is advanced to the preferred working height, the tubular support member 12 is moved to a substantially vertical position where the base portion 12 is firmly positioned on the mine floor. The load bearing surface 26 or the upper surface of a block member is positioned in abutting relation with the mine roof.

With the adjustable jack 10 having been rapidly extended to its working height, nut assembly 28 is returned to the axial bore 76 of the retainer device 56. The threads 36 of the nut assembly 28 mesh with the threads 20 of the adjusting screw 16. The adjusting screw 16 is then locked at the selected height to which it is extended to prevent collapse of the adjusting screw into the tubular support member 12 and permit final setting of the jack by rotation of the adjusting screw 16.

With a load applied to the adjusting screw 16, the nut assembly 28 is moved into load transmitting engagement with the retainer device 56 through the inclined cam faces 82 and 84. Consequently, when the nut assembly and adjusting screw are under load, the respective threads thereof are in meshing relation as illustrated in FIG. 5. It should be noted with respect to FIG. 2, where the nut assembly 28 is shown removed from the retainer device 56, the nut assembly 28 is shown threadedly engaged to the adjusting screw 16 only for illustrative purposes. Therefore, it should be understood that when the nut assembly 28 is removed from the retainer 56 that the nut assembly 28 is removed from meshing engagement with the adjusting screw 16.

Due to the inclination of the threads of the nut assembly 28, nut assembly when in the retainer device 56 is clamped around the adjusting screw ensuring that the adjusting screw will not slip out of engagement with the nut assembly and collapse when a load is applied to the adjusting screw. Rotation of the nut assembly 28 by turning the handles 54 permits the adjusting screw 16 to be adjusted to a final working height or to apply a preselected compressive load, as for example, upon a mine roof to provide support of the mine roof support.

According to the provisions of the patent statutes, I have explained the principle, preferred construction and mode of operation of my invention and have illustrated and described what I now consider to represent it's best embodiments. However, it should be understood, that within the scope of the appended claims, the invention may be practiced otherwise than as specifically illustrated and described.

I claim:

1. An adjustable jack comprising, a tubular support member, said tubular support member having a first end portion and a second end portion, an adjusting screw telescopically positioned in said tubular support member, said adjusting screw having an externally threaded portion, a nut assembly having a pair of radially movable body portions, said nut assembly body portions each having an internally threaded portion engagable with said adjusting screw externally threaded portion, said internally threaded portion of said nut assembly body portions having a thread configuration with an upper surface of each thread having a greater inclination relative to the longitudinal axis of said nut assembly than a lower surface of each thread relative to the longitudinal axis of said nut assembly, means for moving said internally threaded portions of said nut assembly body portions into and out of engagement with said adjusting screw externally threaded portion, a retainer means secured to said tubular support member first end portion for rotatably receiving said nut assembly, said nut assembly being movable into and out of engagement with said retainer means, said nut assembly internally threaded portion being engagable with said adjusting screw externally threaded portion when said nut assembly is positioned in said retainer means so that rotation of said nut assembly in a first direction rotatably extends said adjusting screw from said first end portion of said tubular support member and in a second direction rotatably retracts said adjusting screw into said first end portion of said tubular support member, and said nut assembly internally threaded portions being disengagable with said adjusting screw externally threaded portion when said nut assembly is removed from said retainer means to permit nonrotational linear extension and retraction of said adjusting screw from and into said first end portion of said tubular support member.

2. An adjustable jack as set forth in claim 1 which includes, means for connecting said nut assembly body portions to permit said body portions to move radially toward and away from each other to facilitate threaded engagement and disengagement of said nut assembly with said adjusting screw.

3. An adjustable jack as set forth in claim 2 in which said means for connecting said nut assembly body portions includes, said body portions each having a pair of oppositely aligned passageways, a pair of pin members positioned in said pair of aligned passageways respectively, and said pin members having opposite end portions positioned in said aligned passageways with a selected end of each pin member secured in a respective passageway and said opposite end portion being freely movable in said corresponding opposite passageway to permit relative radial movement of said body portions with respect to said adjusting screw and maintain connection of said body portions to each other.

4. An adjustable jack as set forth in claim 1 which includes, resilient means retained in said nut assembly body portions for normally urging said body portions out of threaded engagement with said adjusting screw.

5. An adjustable jack as set forth in claim 1 which includes, resilient means acting on said nut assembly body portions for urging said body portions in a radial direction out of threaded engagement with said adjusting screw when said nut assembly is removed from said retainer means to permit nonrotational linear advancement of said adjusting screw, and said retainer means having load transmitting means for maintaining said resilient means in a compressed state so that said nut assembly body portions threadedly engage said adjusting screw when said nut assembly is positioned in said retainer means for advancement of said adjusting screw by rotation of said nut assembly.

6. An adjustable jack as set forth in claim 5 in which said resilient means includes, a compression spring extending between said nut assembly body portions, and said compression spring having end portions maintained in contact with said nut assembly body portions so that said compression spring normally urges said nut assembly body portions out of threaded engagement with said adjusting screw.

7. An adjustable jack as set forth in claim 1 in which, said retainer means includes an upper end portion positioned in spaced surrounding relation with said adjusting screw and a lower end portion secured to said first end portion of said tubular support member, and said retainer means upper end portion having load transmitting means for releasably engaging said nut assembly body portions to facilitate extensibility of said adjusting screw in a first mode by rotation when said load transmitting means engages said nut assembly body portions and in a second mode by nonrotational linear advancement when said load transmitting means disengages said nut assembly body portions.

8. An adjustable jack as set forth in claim 1 which includes, handle means connected to said nut assembly for rotating said nut assembly when positioned in said retainer means to rotatably extend said adjusting screw.

9. An adjustable jack as set forth in claim 1 which includes, a load bearing means secured to the upper end of said adjusting screw for receiving a compressive load imparted to said adjusting screw, and means connected to said second end portion of said tubular support member for supporting said adjusting screw in a load bearing position.

10. An adjustable jack as set forth in claim 1 which includes, pin means for connecting said nut assembly body portion halves, and said nut assembly body portion halves being positioned on said pin means for radial movement toward and away from each other to move into and out of threaded engagement with said adjusting screw.

11. An adjustable jack as set forth in claim 1 which includes, a plurality of inclined cam surfaces positioned between and extending downwardly from said internal annular recesses within said retainer means axial bore, said inclined cam surfaces extending between said internal annular recesses, and said nut assembly ring members arranged to move downwardly on said inclined cam surfaces as a compressive load is applied to said adjusting screw to urge said nut assembly into load transmitting engagement with said retainer means and positively engage said nut assembly with said threaded portion of said adjusting screw to prevent slippage of said adjusting screw relative to said nut assembly.

12. An adjustable jack comprising, a tubular support member, said tubular support member having a first end portion and a second end portion, an adjusting screw telescopically positioned in said tubular support member, said adjusting screw having an externally threaded portion, a nut assembly having a body portion being split along a diametrically, axially extending plane to form two halves, said nut assembly body portion halves each having an axially extending semicircular interior surface provided with threads operable to move radially into and out of meshing relation with said externally threaded portion of said adjusting screw, said nut assembly body portion having a plurality of axially spaced ring members extending externally from the outer periphery of said nut assembly body portion halves, retainer means secured to said tubular support member first end portion for rotatably receiving said nut assembly, said nut assembly being movable axially on said adjusting screw into and out of said retainer means, said nut assembly being threadedly engaged with said adjusting screw when positioned in said retainer means, said nut assembly being removed from threaded engagement with said adjusting screw when positioned out of said retainer means, said retainer means having an axial bore extending therethrough, said axial bore having a plurality of internal annular recesses axially spaced along the length of said axial bore, said internal annular recesses having a diameter greater than the diameter of said external ring members of said nut assembly body portion to permit axial movement of said nut assembly into and out of said retainer means axial bore, said external ring members being movable into and out of position oppositely of said internal annular recesses, resilient means extending between said nut assembly body portion halves for connecting said body portion halves to permit said body portion halves to move radially toward and away from each other, said resilient means being operable when said nut assembly is positioned in said retainer means to urge said external ring members into said internal annular recesses so that said nut assembly body portion halves are maintained in threaded engagement with said adjusting screw to permit rotational extension and retraction of said adjusting screw by rotation of said nut assembly, and said resilient means being operable when said nut assembly is positioned out of said retainer means to urge said nut assembly body portion halves out of threaded engagement with said adjusting screw to permit nonrotational linear extension and retraction of said adjusting screw.

* * * * *